US006918808B2

(12) United States Patent
Fukuyo et al.

(10) Patent No.: US 6,918,808 B2
(45) Date of Patent: Jul. 19, 2005

(54) ARC TUBE FOR DISCHARGE LAMP AND METHOD FOR PRODUCING THE SAME

(75) Inventors: Takeshi Fukuyo, Shizuoka (JP); Yoshitaka Oshima, Shizuoka (JP); Shinichi Irisawa, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 5 days.

(21) Appl. No.: 10/234,334

(22) Filed: Sep. 5, 2002

(65) Prior Publication Data

US 2003/0048078 A1 Mar. 13, 2003

(30) Foreign Application Priority Data

Sep. 7, 2001 (JP) ..... P. 2001-271357

(51) Int. Cl.[7] ..... H01J 9/32
(52) U.S. Cl. ..... 445/26; 445/43
(58) Field of Search ..... 445/43, 26, 27, 445/40, 22, 46–48; 313/623–634; 140/71.5

(56) References Cited

U.S. PATENT DOCUMENTS 3,582,704 A * 6/1971 Fridrich ..... 313/331
3,693,241 A * 9/1972 Fridrich ..... 228/164
4,587,454 A * 5/1986 Bonazoli et al. ..... 313/331
5,286,227 A 2/1994 Numajiri et al.
5,980,977 A * 11/1999 Deng et al. ..... 427/79
6,354,900 B1 3/2002 Ohshima et al.
2003/0234612 A1 * 12/2003 Kelly et al. ..... 313/623

* cited by examiner

*Primary Examiner*—Joseph Williams
(74) *Attorney, Agent, or Firm*—Sughrue Mion, PLLC

(57) ABSTRACT

A discharge lamp arc tube in which a pair of electrode assemblies each having an electrode rod, a sheet of molybdenum foil and a lead wire integrally series-connected to one another have respective molybdenum foil containing regions pinch-sealed with glass, and electrodes are disposed opposite to each other in a closed glass bulb containing a light emitting substance or the like enclosed therein. The surface of the sheet of molybdenum foil sealed at each of the pinch seal portions has a micro-asperity surface roughened by an etching treatment including oxidation and reduction, so that silica glass is closely packed in the micro-asperity of the surface of the sheet of molybdenum foil. As a result, the adhesion (mechanical bonding strength) in the interface between silica glass and molybdenum foil is improved so that foil rising is suppressed and, accordingly, the lifetime of the arc tube is extended.

11 Claims, 7 Drawing Sheets

FIG.4

CONDITION FOR OXIDATION TREATMENT OF SHEET OF MOLYBDENUM FOIL, AND CHANGE IN ATOMIC PERCENTAGE OF OXYGEN AND IN EXTERNAL APPEARANCE

| TREATMENT TEMPERATURE | TREATMENT TIME | ATOMIC PERCENTAGE OF OXYGEN | EXTERNAL APPEARANCE (COLOR) |
|---|---|---|---|
| 400°C | 1 min. | 52.52% | LIGHT BROWN |
| | 3 min. | 61.26% | LIGHT BROWN |
| | 5 min. | 62.74% | LIGHT BROWN |
| | 10 min. | 63.60% | DARK BROWN |
| | 15 min. | 62.86% | BLUISH VIOLET |
| | 20 min. | 64.57% | BLUISH VIOLET |
| | 25 min. | 66.41% | BLUISH VIOLET |
| | 30 min. | 62.76% | BLUISH VIOLET |
| 425°C | 1 min. | 55.71% | LIGHT BROWN |
| | 3 min. | 59.63% | LIGHT BROWN |
| | 5 min. | 58.92% | DARK BROWN |
| | 10 min. | 62.64% | BLUISH VIOLET |
| | 15 min. | 68.51% | BLUISH VIOLET |
| | 20 min. | 67.51% | LIGHT BLUE |
| | 25 min. | 63.67% | LIGHT BLUE |
| | 30 min. | 68.24% | LIGHT BLUE |
| 450°C | 1 min. | 56.10% | LIGHT BROWN |
| | 3 min. | 62.63% | BLUISH VIOLET |
| | 5 min. | 68.04% | LIGHT BLUE |
| | 10 min. | 67.94% | LIGHT BLUE |
| | 15 min. | 72.51% | LIGHT BROWN |
| | 20 min. | 70.10% | LIGHT BROWN |
| | 25 min. | 75.41% | LIGHT BROWN |
| | 30 min. | 74.89% | LIGHT BROWN |

RELATION BETWEEN OXIDATION TREATMENT TIME AND ATOMIC PERCENTAGE OF OXYGEN

FIG.6

TREATMENT CONDITION FOR SHEET OF MOLYBDENUM FOIL AND ATOMIC PERCENTAGE OF OXYGEN

| | TREATMENT CONDITION | ATOMIC PERCENTAGE OF OXYGEN | ASPERITY | FOIL COLOR |
|---|---|---|---|---|
| (REFERENCE) | BEFORE TREATMENT | 33.42% | | SILVER |
| SPECIFICATION 1 | 300℃*30 MIN. OXIDATION | 50.01% | | LIGHT YELLOW |
| SPECIFICATION 2 | 370℃*30 MIN. OXIDATION | 54.56% | | LIGHT YELLOW |
| SPECIFICATION 3 | 400℃*30 MIN. OXIDATION | 63.00% | | BLUISH VIOLET |
| SPECIFICATION 4 | 500℃*30 MIN. OXIDATION | 76.73% | (LARGE) | DARK GRAY |
| SPECIFICATION 5 | 600℃*30 MIN. OXIDATION | 83.15% | (LARGE) | DARK GRAY |
| SPECIFICATION 6 | 300℃*30 MIN. OXIDATION AND 900℃*20 MIN. REDUCTION | 28.69% | | SILVER |
| SPECIFICATION 7 | 370℃*30 MIN. OXIDATION AND 900℃*20 MIN. REDUCTION | 33.72% | | SILVER |
| SPECIFICATION 8 | 400℃*30 MIN. OXIDATION AND 900℃*20 MIN. REDUCTION | 39.37% | | SILVER |
| SPECIFICATION 9 | 500℃*30 MIN. OXIDATION AND 900℃*20 MIN. REDUCTION | 30.71% | (LARGE) | DARK GRAY |
| SPECIFICATION 10 | 600℃*30 MIN. OXIDATION AND 900℃*20 MIN. REDUCTION | 38.00% | (LARGE) | DARK GRAY |

W
W1
W2
W3
A
A'
Xe
LN2
22
24
24a
24b
26a
26b
26c
40
42
44
50
52
54
6
7
8
8b
P

ARC TUBE FOR DISCHARGE LAMP AND METHOD FOR PRODUCING THE SAME

BACKGROUND OF THE INVENTION

1. Field of the Invention

The present invention relates to a discharge lamp arc tube and a method of producing the arc tube. More particularly, the present invention relates to a discharge lamp arc tube and a method for producing the arc tube in which molybdenum foil, used in pinch seal portions for providing airtighteness to the glass bulb of the arc tube, has a roughened surface created by etching the foil using oxidation and reduction treatments.

2. Description of the Related Art

FIG. 8 shows a related art discharge lamp. The discharge lamp has a structure in which front and rear end portions of an arc tube 5 are integrated with an electrically insulating base 1 while supported by a lead support 2 and a metal grip member S. The lead support 2 serves also as a current conduction path protruded frontward from the electrically insulating base 1, and the metal grip member S is fixed to the front of the electrically insulating base 1.

The arc tube 5 further has a structure in which a closed glass bulb 5*a* provided with a pair of opposite electrode rods 6 and 6 and filled with a light emitting substance or the like is formed between a pair of front and rear pinch seal portions 5*b* and 5*b*. A sheet of molybdenum foil 7 for connecting the electrode rod 6 protruded into the closed glass bulb 5*a* and a lead wire 8 led out from the pinch seal portion 5*b* is sealed in the inside of the pinch seal portion 5*b*, so that the pinch seal portion 5*b* is kept airtight.

The electrode rod 6 is most preferably made of tungsten because of that material's excellent durability. However, since the linear expansion coefficient of tungsten is largely different from that of glass, tungsten is unfamiliar with glass and therefore, inferior in airtightness. Accordingly, when the sheet of molybdenum foil 7 having a linear expansion coefficient near to that of glass and relatively familiar with glass is connected to the tungsten electrode rod 6 and sealed at the pinch seal portion 5*b*, the pinch seal portion 5*b* can be kept airtight.

Further, ultraviolet-shielding shroud glass G is integrally welded to the arc tube 5. A region from the pinch seal portion 5*b* to the closed glass bulb 5*a* is covered with the shroud glass G so that an ultraviolet-ray component having a wavelength region harmful to the human body in light emitted from the arc tube 5 is cut-off. At the same time, the region from the pinch seal portion 5*b* to the closed glass bulb 5*a* is surrounded by a closed space formed by the shroud glass G so that the closed glass bulb 5*a* is kept at a high temperature.

In the related art arc tube, although it can be said that the sheet of molybdenum foil 7 sealed at the pinch seal portion 5*b* is familiar with glass, it cannot be said that the linear expansion coefficient of the molybdenum foil 7 is quite the same as that of glass. Also the difference between the temperature at the time of switching on the lamp and the temperature at the time of switching off the lamp is large and, therefore, thermal stress is generated in the interface between molybdenum foil 7 and glass with the change of the temperature. Moreover, vibration of an engine or vibration generated with the running of a car is transmitted to the arc tube. Therefore, there becomes a problem that a gap can be formed between the molybdenum foil 7 and the glass material in use for a long term. That is, foil rising occurs which leads to leakage of a sealing substance contained in the closed glass bulb.

Therefore, the present inventor has conceived that such foil rising may be prevented when the adhesion (mechanical bonding strength) between molybdenum foil and glass in each pinch seal portion is enhanced and, accordingly, a surface of the sheet of molybdenum foil is provided as a roughened surface having a micro-asperity shape. It has been then confirmed that foil rising can be suppressed effectively when a sheet of molybdenum foil is subjected to an oxidation treatment and then subjected to a reduction treatment so that a roughened surface having a micro-asperity shape is formed on a surface of the sheet of molybdenum foil and the sheet of molybdenum foil having such a roughened surface is sealed at a pinch seal portion.

SUMMARY OF THE INVENTION

An object of the present invention is to provide a discharge lamp arc tube in which foil rising is prevented from occurring in the inside of each pinch seal portion.

In order to achieve the foregoing object, according to a first aspect of the invention, there is provided a discharge lamp arc tube including a pair of electrode assemblies each including an electrode, molybdenum foil, and a lead wire integrally series-connected to one another. Molybdenum foil-containing portions of the electrode assemblies are pinch-sealed with glass portions of the arc tube. A portion of each of the electrodes are disposed opposite to one another in a glass bulb of the arc tube which has a light emitting substance enclosed therein. The molybdenum foil at the molybdenum foil-containing portions has a rough surface. The rough surface may be formed by etching, and in particular, oxidation and reduction treatments.

Further, according to a second aspect of the invention, there is provided a method for producing a discharge lamp arc tube having molybdenum foil with a rough surface at pinch seal portions of the arc tube comprising:

etching the molybdenum foil to provide the molybdenum foil with the rough surface;

preparing a pair of electrode assemblies, each including an electrode, the molybdenum foil, and a lead wire integrally series-connected to one another; and pinch sealing molybdenum foil-containing portions of the electrode assemblies with glass portions of the arc tube to form the pinch seal portions of the arc tube. In this second aspect, the etching includes an oxidation treatment and a reduction treatment of the molybdenum foil.

(Operation) An oxide film ($MoO$, $MoO_2$, $MoO_3$, $Mo_4O_{11}$, or the like) is formed on a surface of a sheet of molybdenum foil subjected to an oxidation treatment, so that the surface is provided as a roughened surface having a micro-asperity shape. When the roughened surface is further subjected to a reduction treatment, oxygen atoms in the oxide film are removed to thereby form a roughened surface (etched surface) on the surface of the sheet of molybdenum foil to have a deeper and more complicated micro-asperity shape than the micro-asperity shape formed on the surface of the sheet of molybdenum foil subjected to an oxidation treatment. By virtue of this roughened surface, the pinch seal portion gets into a state in which silica glass is closely packed in the deep and complicated micro-asperity in the surface of the sheet of molybdenum foil. As a result, the adhesion, namely, mechanical bonding strength in the interface between the silica glass and the molybdenum foil is improved.

According to a third aspect of the invention, in the discharge lamp arc tube producing method stated in the second aspect, a temperature used for the oxidation treatment of the molybdenum foil is set to be in a range of 300° C. to 500° C.

(Operation) If the temperature for the oxidation treatment of the sheet of molybdenum foil is lower than 300° C., an impractically long time is required for forming an oxide film on the surface of the sheet of molybdenum foil. A higher temperature is preferred because oxidation progresses so rapidly that the oxidation treatment time becomes short. Moreover, when the oxidation treatment temperature is higher, the depth and the complexity of micro-asperity in the surface of the sheet of molybdenum foil after the oxidation treatment is increased and the depth and the complexity of micro-asperity in the surface of the sheet of molybdenum foil after the oxidation and reduction treatments is also increased. Therefore, the oxidation treatment temperature may be preferably higher from the point of view of increasing the mechanical bonding strength between glass and molybdenum foil. However, if the oxidation treatment temperature is higher than 500° C., the sheet of molybdenum foil becomes fragile (visually dark gray as the color of the surface thereof) due to excessive oxidation. As a result, there is a fear that reduction in weldability to an electrode rod or foil rising at the time of pinch-sealing may occur. Therefore, the sheet of molybdenum foil is preferably subjected to an oxidation treatment at a temperature in a range of 300° C. to 500° C.

According to a fourth aspect of the invention, during the oxidation treatment, an atomic percentage of oxygen in the molybdenum foil is set to be in a range of 50% to 80% and preferably, in a range of 60% to 70%.

(Operation) If the atomic percentage of oxygen contained in the sheet of molybdenum foil subjected to an oxidation treatment is less than 50%, the micro-asperity shape of the surface of the sheet of molybdenum foil (oxide film) is shallow and flat and the micro-asperity formed in the surface of the sheet of molybdenum foil after a reduction treatment cannot be obtained as a micro-asperity having depth and complexity sufficient to enhance the mechanical bonding strength to silica glass. Accordingly, in order to deepen and complicate the micro-asperity shape of the surface of the sheet of molybdenum foil after the reduction treatment, the micro-asperity shape of the surface of the sheet of molybdenum foil subjected to an oxidation treatment before a reduction treatment is preferably made deep and complicated, that is, the atomic percentage of oxygen contained in the sheet of molybdenum foil subjected to an oxidation treatment is preferably as high as possible. If the atomic percentage of oxygen contained in the sheet of molybdenum foil subjected to an oxidation treatment is higher than 80%, however, the sheet of molybdenum foil becomes fragile (visually dark gray as the color of the surface thereof) because of the excessive atomic percentage of oxygen contained in the sheet of molybdenum foil. As a result, there is a fear that reduction in weldability to an electrode rod or foil breaking at the time of pinch-sealing may occur. In addition, if the atomic percentage of oxygen contained in the sheet of molybdenum foil after the reduction treatment is high, there is a fear that a large amount of oxygen atoms contained in the sheet of molybdenum foil may be liberated at the time of pinch-sealing and enclosed as an oxygen gas in the closed glass bulb to thereby give bad influence on the luminous flux retaining factor, the light color and the lamp voltage.

According to a fifth aspect of the invention, a temperature for pinch-sealing the silica glass tube is set to be in a range of 2000° C. to 2300° C.

(Operation) In a pinch seal step of pinching a silica glass tube, generally, a pair of pinchers which repel each other when they approach each other are used. When the temperature for pinch-sealing the silica glass tube is not lower than 2000° C., the viscosity of molten glass is reduced so that the molten glass surely permeates into the inside of the micro-asperity of the surface of the sheet of molybdenum foil to result in a state in which the silica glass is closely packed in the inside of the micro-asperity of the surface of the sheet of molybdenum foil. If the temperature for pinch-sealing the silica glass tube is lower than 2000° C., the viscosity of molten glass is so high that the molten glass cannot surely permeate into the inside of the micro-asperity of the surface of the sheet of molybdenum foil, and there is a fear that a gap may be formed between the molten glass and the micro-asperity. On the other hand, if the temperature for pinch-sealing the silica glass tube is higher than 2300° C., a larger amount of thermal energy is required for heating the silica glass because either burners or pinchers must be made of a raw material having excellent thermal resistance properties.

BRIEF DESCRIPTION OF THE DRAWINGS

FIG. 4 is a view in tabular form showing the condition for oxidation of the sheet of molybdenum foil, and the change in the atomic percentage of oxygen and in the external appearance.

FIG. 6 is a view in tabular form showing the condition for treating the sheet of molybdenum foil, and the change in the atomic percentage of oxygen, in the micro-asperity shape of the surface of the sheet of molybdenum foil and in the external appearance.

DETAILED DESCRIPTION OF THE PREFERRED EMBODIMENTS

A mode for carrying out the present invention will be described below based on an embodiment thereof.

FIGS. 1 to 7 show an embodiment of the present invention.

Figure 8:
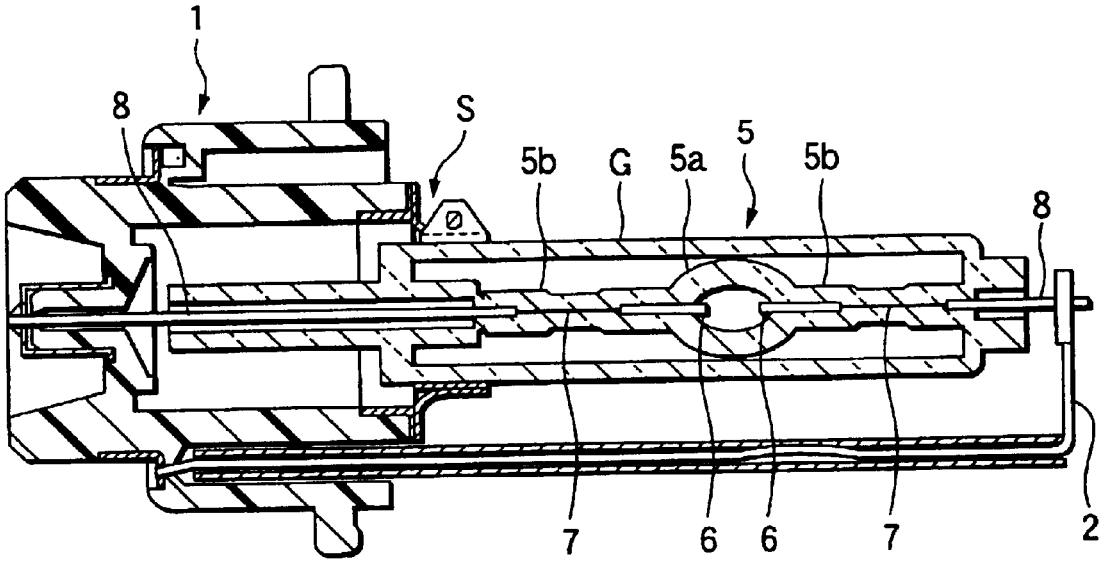
FIG. 8 is a sectional view of a related art discharge lamp.

In these drawings, a discharge lamp provided with an arc tube 10 has a similar structure as the related art structure shown in FIG. 8, and as such, the description of similar structure will be omitted.

The arc tube 10 has a structure in which a circular pipe-shape silica glass tube W having a linear stretched portion $w_1$ and a spherical swollen portion $w_2$ formed on the way in the longitudinal direction of the linear stretched portion $w_1$ is pinch-sealed at positions close to the spherical swollen portion $w_2$ so that pinch seal portions 13 (a primary pinch seal portion 13A and a secondary pinch seal portion 13B) each shaped like a rectangle in cross section are formed in opposite end portions of an ellipsoidal chipless closed glass bulb 12 constituting a discharge space. Starting rare gas, for example, mercury and metal halide (hereinafter referred to as "light emitting substance or the like") is enclosed in the closed glass bulb 12. A pair of tungsten electrode rods 6 and 6 constituting discharge electrodes are disposed in the closed glass bulb 12 so as to be opposite to each other. Each of the electrode rods 6 and 6 is connected to a sheet of molybdenum foil 7 sealed at corresponding pinch seal portions 13. Molybdenum lead wires 8 connected to the sheets of molybdenum foil 7 respectively are led out from end portions of the pinch seal portions 13. The rear end side lead wire 8 is extended to the outside through a circular pipe-shaped portion 14 which is a non-pinch seal portion. The reference symbol G designates cylindrical ultraviolet-shielding shroud glass integrally welded to the arc tube 10. An ultraviolet-ray component having a wavelength range harmful to the human body in light emitted from the arc tube 10 is cut off by the shroud glass. A closed space between the shroud glass G and the arc tube 10 is filled with an inert gas in a pressure of 1 atmosphere or less so that the closed glass bulb 12 is kept at a high temperature.

Figure 1:
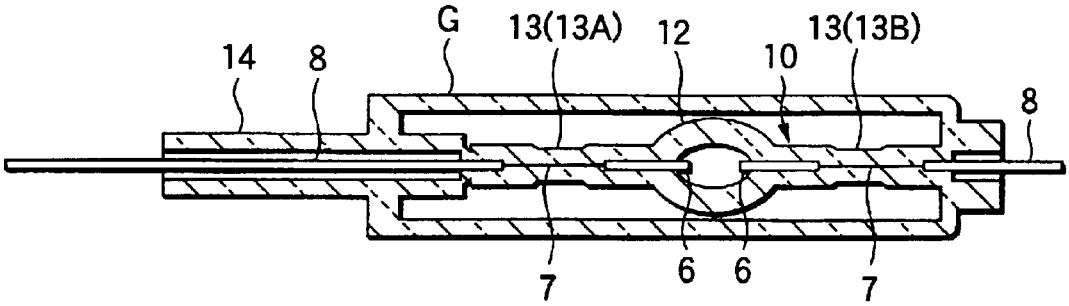
FIG. 1 is a vertical sectional view of an arc tube as an embodiment of the present invention.
Figure 2:
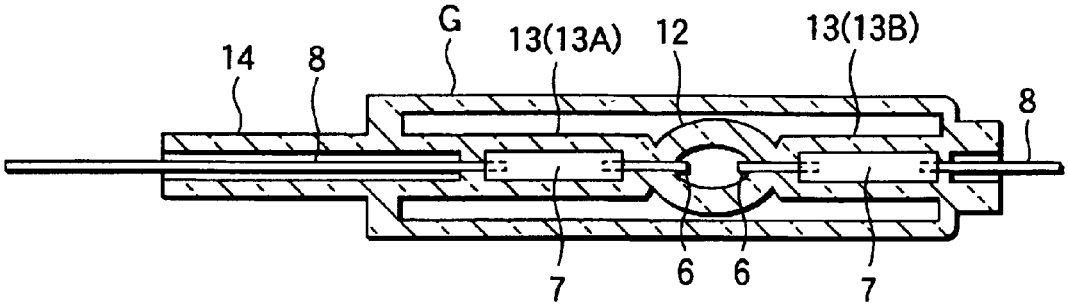
FIG. 2 is a horizontal sectional view showing pinch seal portions in the arc tube.
Figure 3A:
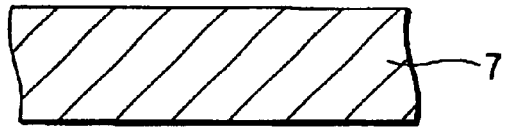
FIGS. 3(*a*) to 3(*d*) are views showing a state in which a sheet of molybdenum foil is subjected to an oxidation treatment and a reduction treatment so that the surface shape of the sheet of molybdenum foil changes, FIG. 3(*a*) being a sectional view of a sheet of molybdenum foil before the oxidation treatment, FIG. 3(*b*) being a sectional view of the sheet of molybdenum foil after the oxidation treatment, FIG. 3(*c*) being a sectional view of the sheet of molybdenum foil subjected to the reduction treatment after the oxidation treatment, and FIG. 3(*d*) being a sectional view showing a neighbor of the interface between molybdenum foil and silica glass in the pinch seal portion.
Figure 3B:
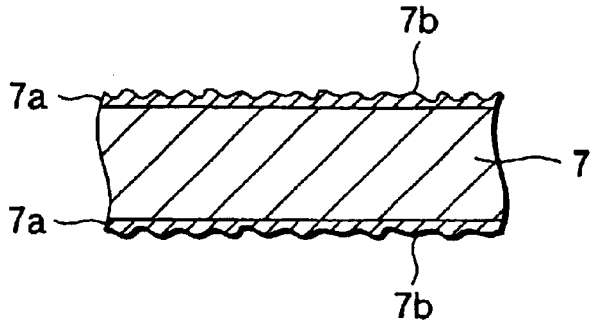
Figure 3C:
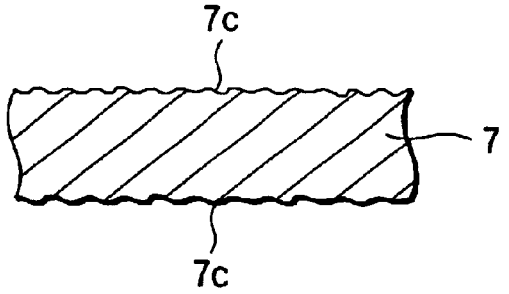
Figure 3D:
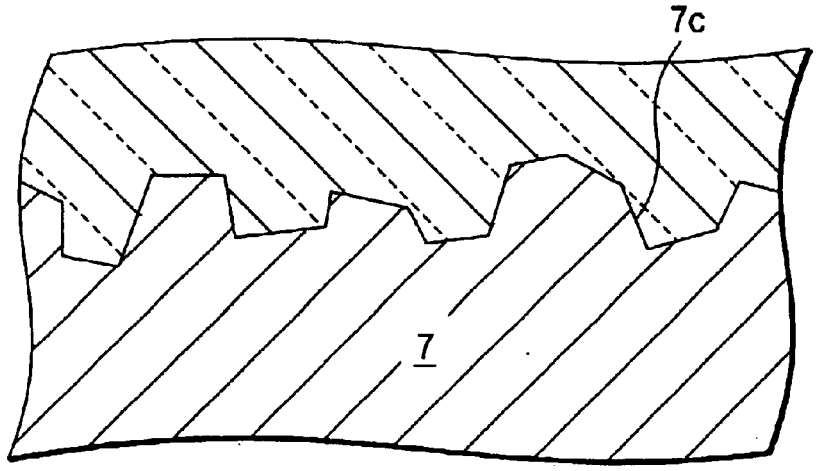

The external appearance structure of the arc tube 10 shown in FIG. 1 is not apparently different from that of the related art arc tube 5 shown in FIG. 8. Surfaces of the sheets of molybdenum foil 7 pinch-sealed are, however, subjected to a surface roughening etching treatment including oxidation and reduction treatments which will be described later to thereby form roughened surfaces 7*c* each having a deep and complicated micro-asperity shape as shown in FIGS. 3(*c*) and 3(*d*). By virtue of the roughened surfaces, each of the pinch seal portions 13 gets into a state that silica glass is closely packed in the deep and complicated micro-asperity of the surface of the sheet of molybdenum foil 7. As a result, the adhesion, that is, mechanical bonding strength in the interface between silica glass and molybdenum foil 7 is improved to thereby suppress foil rising at the pinch seal portions 13 to thereby promote a long lifetime of the arc tube.

That is, in the present invention, when a sheet of molybdenum foil 7 is first put in an oxidation treatment furnace and subjected to an oxidation treatment for a predetermined time, an oxide film (MoO, $MoO_2$, $MoO_3$, $Mo_4O_{11}$ or the like) 7*a* is formed on a surface of the sheet of molybdenum foil 7 as shown in FIG. 3(*b*). The surface of the sheet of molybdenum foil 7 before the oxidation treatment is flat as shown in FIG. 3(*a*). By the oxidation treatment, however, the surface (the surface of the oxide film 7*a*) is formed as a roughened surface 7*b* having a micro-asperity shape (see FIG. 3(*b*)). When the sheet of molybdenum foil 7 subjected to the oxidation treatment thus is then put in a reduction treatment furnace filled with a hydrogen gas and subjected to a reduction treatment for a predetermined time, oxygen atoms in the oxide film 7*a* are removed so that the surface of the sheet of molybdenum foil 7 is formed as a roughened surface (etched surface) 7*c* having a deeper and more complicated micro-asperity shape as shown in FIG. 3(*c*) than the micro-asperity shape formed in the surface (the roughened surface 7*b*) of the sheet of molybdenum foil subjected to the oxidation-treatment.

The mechanism that the surface of the sheet of molybdenum foil 7 is formed as an etched surface 7*c* can be presumed as follows. That is, the degree of the asperity formed in the surface (the surface of the oxide film 7*a*) of the sheet of molybdenum foil 7 subjected to the oxidation treatment as shown in FIG. 3(*b*) is substantially the same as that of the asperity of the surface of the sheet of molybdenum foil 7 before the oxidation treatment. However, when the sheet of molybdenum foil 7 is further subjected to the reduction treatment as shown in FIG. 3(*c*), oxygen and the oxide film are more removed on the basis of the etching effect and the sublimation of the oxide film due to the temperature so that a deeper and more micro asperity is formed in the surface of the sheet of molybdenum foil 7. On this occasion, since MoO, $MoO_2$, $MoO_3$, $Mo_4O_{11}$, or the like is mixed in the oxide film 7*a*, oxygen and the oxide film are removed more complicatedly from the sheet of molybdenum foil 7 by the reduction treatment so that a deeper and more micro asperity is formed in the surface of the sheet of molybdenum foil 7.

Figure 5:
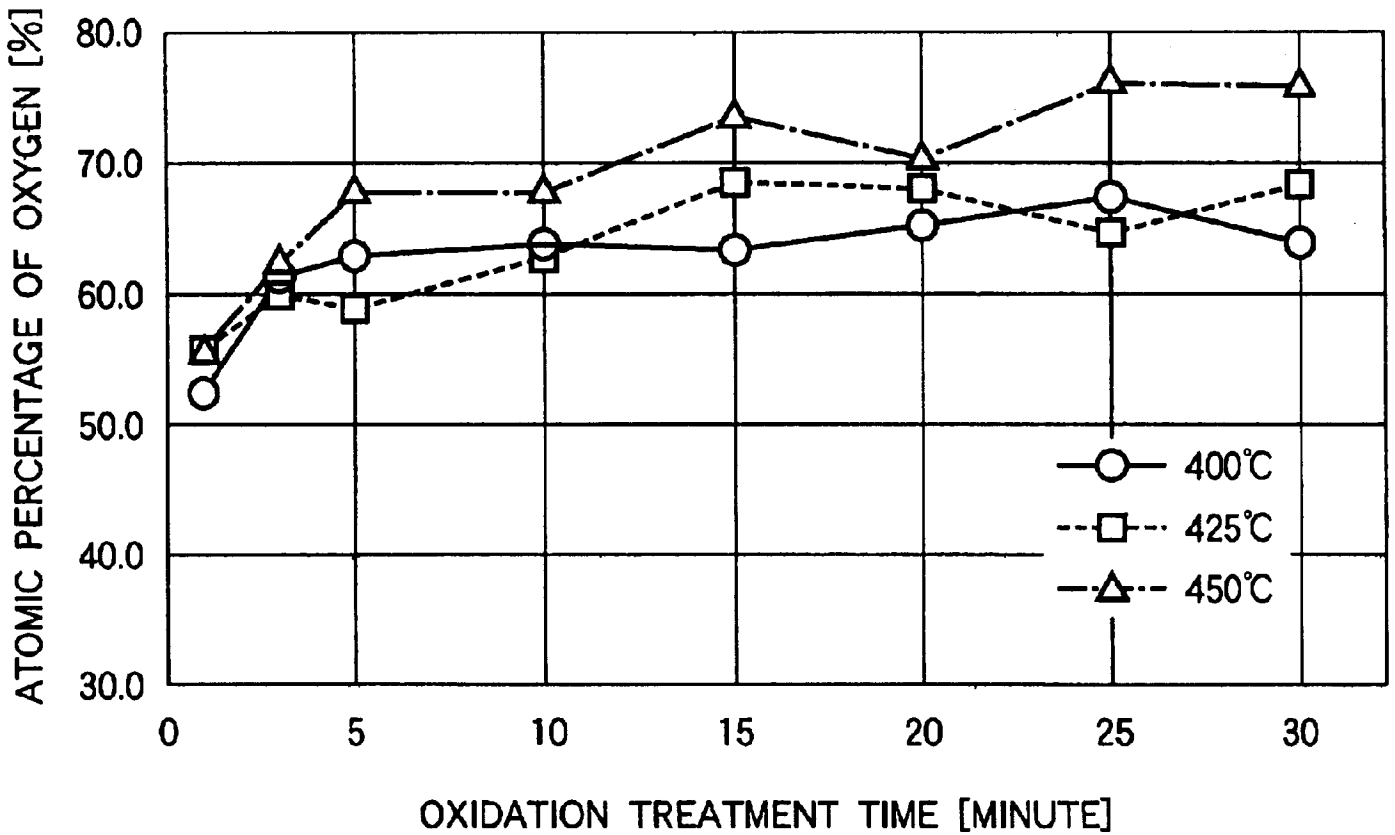
FIG. 5 is a view in graph form showing the table of FIG. 4.

FIGS. 4 and 5 show the relation between the oxidation condition and the changes in atomic percentage of oxygen and in external appearance, which relation is obtained when data obtained by the present inventor's experiment of the oxidation treatment of molybdenum foil is observed and analyzed with SEM-EMAX. As shown in these Figures, the atomic percentage of oxygen is proportional both to the oxidation treatment temperature and to the treating time.

FIG. 6 is a view showing the relation between the condition for the oxidation and reduction treatments of molybdenum foil and the changes in atomic percentage of oxygen, in micro-asperity shape of the surface of the sheet of molybdenum foil and in external appearance thereof, which relation is obtained when data obtained by the present inventor's experiment of the oxidation and reduction treatments of molybdenum foil are observed and analyzed with SEM-EMAX. The surface roughness (the depth and complexity of the micro-asperity shape) of the sheet of molybdenum foil after the oxidation and reduction treatments is proportional both to the oxidation treatment temperature and to the atomic percentage of oxygen. In any case of specifications 6 to 10, when the reduction treatment is applied after the oxidation treatment, the atomic percentage of oxygen returns to the atomic percentage (33.42%) of oxygen obtained before the oxidation treatment. As the atomic percentage of oxygen contained in the sheet of molybdenum foil obtained by the oxidation treatment increases, the atomic percentage of oxygen obtained after the reduction treatment increases and the surface roughness (the depth and complexity of the micro-asperity) increases.

As the temperature for the oxidation treatment of the sheet of molybdenum foil becomes higher, oxidation progresses more rapidly and the oxidation treatment time becomes shorter, preferably. However, if the temperature is lower than 300° C., an impractically long time is required for forming an oxide film on the surface of the sheet of molybdenum foil. If the temperature is higher than 500° C., the surface of the sheet of molybdenum foil is visually colored in dark gray and becomes fragile because of excessive oxidation. As a result, there is a fear that reduction in weldability to an electrode rod or foil breaking at the time of pinch-sealing may occur. Therefore, the sheet of molybdenum foil is preferably subjected to the oxidation treatment at a temperature in a range of 300° C. to 500° C.

If the atomic percentage of oxygen contained in the sheet of molybdenum foil after the oxidation treatment is less than 50%, the micro-asperity shape of the surface 7*b* of the sheet of molybdenum foil 7 (oxide film 7*a*) is shallow and flat and, accordingly, the micro-asperity formed in the surface 7*c* of the sheet of molybdenum foil after the reduction treatment also cannot have the depth and complexity sufficient to increase the mechanical bonding strength to silica glass. Accordingly, in order to deepen and complicate the micro-asperity shape of the surface 7*c* of the sheet of molybdenum foil subjected to the oxidation and reduction treatments, the atomic percentage of oxygen contained in the sheet of molybdenum foil obtained after the oxidation treatment is preferably made high. If the atomic percentage of oxygen contained in the sheet of molybdenum foil obtained after the oxidation treatment is higher than 80%, there is, however, a fear that reduction in weldability to an electrode rod or foil breaking at the time of pinch-sealing may occur because the surface of the sheet of molybdenum foil is visually colored in dark gray and becomes fragile due to excessive oxidation. Even after the reduction treatment is applied, the atomic percentage of oxygen contained in the sheet of molybdenum foil is so high that a large amount of oxygen atoms contained in the sheet of molybdenum foil may be liberated at the time of pinch-sealing. As a result, there is a fear that oxygen may be enclosed as an oxygen gas in the closed glass bulb to thereby give bad influence on the luminous flux retaining factor, the light color and the lamp voltage. Accordingly, the atomic percentage of oxygen contained in the sheet of molybdenum foil after the oxidation treatment is set to be in a range of 50% to 80%, and preferably in a range of 60% to 70%.

The micro-asperity of the surface of the sheet of molybdenum foil is preferably not smaller than 1 $\mu$m (reference length: 0.08 mm) in terms of ten-point average roughness.

In order to mass-produce sheets of molybdenum foil 7 each having the aforementioned etched surface (the surface subjected to the oxidation and reduction treatments), a molybdenum foil spool wound with a long belt of molybdenum foil is unwound and passed through an oxidation treatment furnace and a reduction treatment furnace successively to thereby apply an etching treatment to the surface of the molybdenum foil spool material. Then, the belt of molybdenum foil is rewound onto the spool to thereby obtain a spool wound with a long belt of molybdenum foil having an etched surface. When the spool wound with the belt of etched molybdenum foil is then unwound and the belt of molybdenum foil is cut into a predetermined length, a sheet of molybdenum foil 7 having a predetermined size and having an etched surface can be obtained. Then, an electrode rod 6 and a lead wire 8 are integrally welded in series to the sheet of molybdenum foil 7 having such an etched surface to thereby form an electrode assembly A (or A').

In a pinch seal step, generally, a pair of pinchers are used for pinching a silica glass tube. When the temperature for pinch-sealing the silica glass tube is not lower than 2000° C., the viscosity of molten glass is reduced so that the molten glass surely permeates into the micro-asperity of the surface of the sheet of molybdenum foil to result in a state where the silica glass is closely packed in the micro-asperity of the surface of the sheet of molybdenum foil. If the temperature for pinch-sealing the silica glass tube is lower than 2000° C., however, the viscosity of molten glass is so high that the molten glass cannot surely permeate into the micro-asperity of the surface of the sheet of molybdenum foil and there is a fear that a gap may be formed between the molten glass and the micro-asperity. On the other hand, if the temperature for pinch-sealing the silica glass tube is higher than 2300° C., a larger amount of thermal energy is required for heating the silica glass because either burners or pinchers must be made of a raw material excellent in thermal resistance. Accordingly, the temperature for pinch-sealing the silica glass tube is preferably set to be in a range of 2000° C. to 2300° C.

The sheet of molybdenum foil 7 is made of molybdenum doped with yttria ($Y_2O_3$) and has a structure in which a molybdenum foil 7-containing region of a glass tube is pinch-sealed at a high temperature, for example, from 2000° C. to 2300° C. to thereby make recrystallized particles of the recrystallized molybdenum foil fine. The fine structure of recrystallized particles of molybdenum foil in the pinch seal portion 13 is effective in absorbing thermal stress generated in the interface between glass and molybdenum foil at the time of switching on/off the lamp to thereby prevent foil rising.

The process of producing the arc tube 10 having the chipless closed glass bulb 12 shown in FIG. 1 will be described below with reference to FIG. 7.

First, a glass tube W having a linear stretched portion w1 and a spherical swollen portion w2 formed on the way of the linear stretched portion w1 is produced in advance. Electrode assemblies A and A' each having a sheet of molybdenum foil 7 (a sheet of molybdenum foil having a roughened surface 7*c* of a micro-asperity shape) subjected to a surface-roughening etching treatment (oxidation and reduction treatments), and an electrode rod 6 and a lead wire 8 integrally welded to the sheet of molybdenum 7 are prepared in advance. As shown in FIG. 7(*a*), while the glass tube W is kept vertical, the electrode assembly A is inserted through a lower opening end side of the glass tube W and kept in a predetermined position. At the same time, an inert gas (argon gas or nitrogen gas) supply nozzle 40 is inserted through an upper opening end of the glass tube W. A lower end portion of the glass tube W is further inserted into an inert gas (argon gas or nitrogen gas) supply pipe 50.

An inert gas supplied from the nozzle 40 is a gas for preventing the electrode assembly A from being oxidized at the time of pinch-sealing. An inert gas supplied from the gas supply pipe 50 is a gas for keeping the lead wire 8 in an atmosphere of the inert gas to prevent the lead wire 8 from being oxidized at the time of pinch-sealing and during the high-temperature state of the lead wire 8 after the pinch-sealing. In FIG. 7(*a*), the reference numerals 42 and 52 designate gas cylinders filled with inert gas; 44 and 54, gas pressure regulators; and 22, a glass tube grip member.

Figures 7A, 7B, 7C, 7D, 7E:
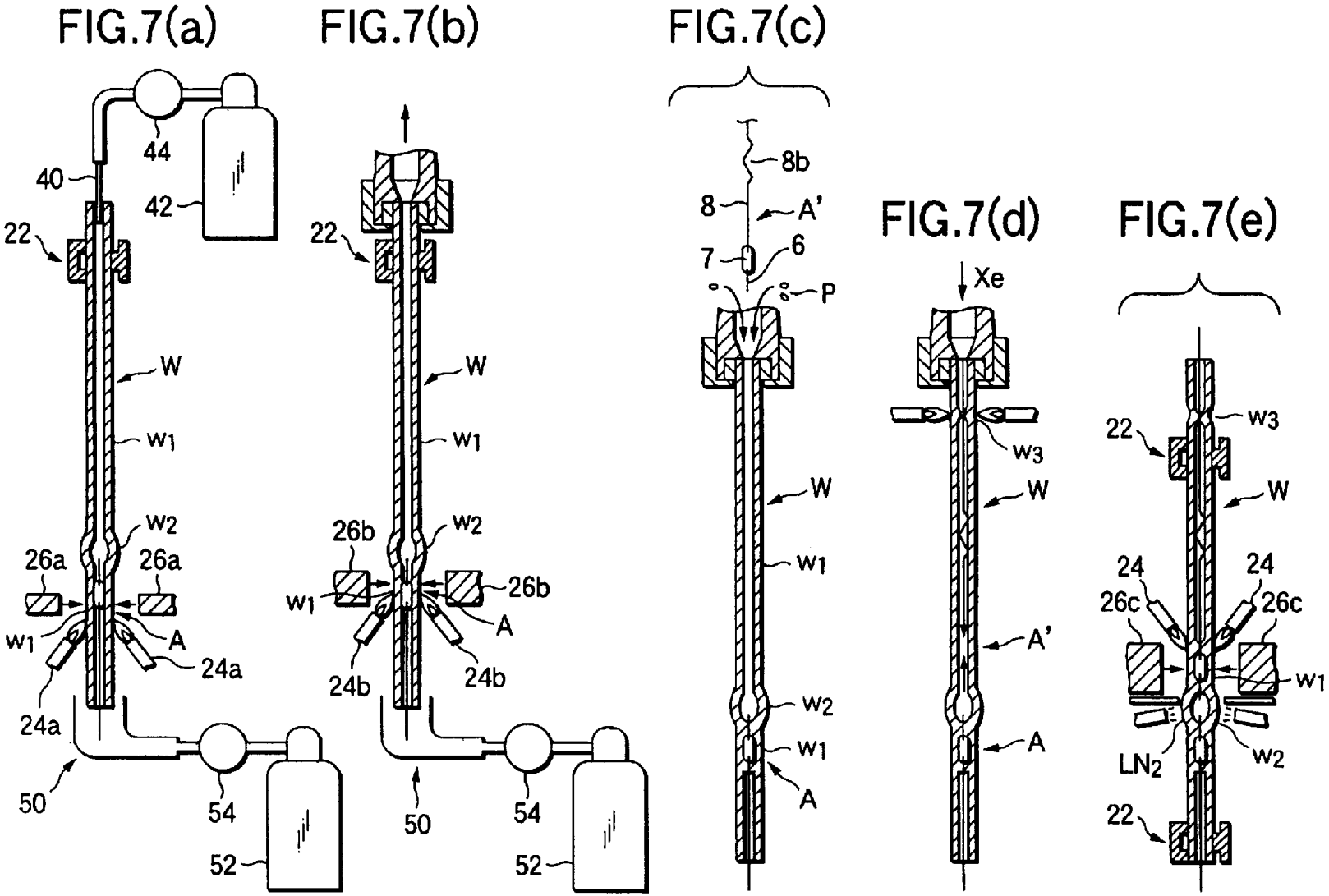
FIGS. 7(*a*) to 7(*e*) are views for explaining the method of the invention of producing the arc tube, FIG. 7(*a*) being a view for explaining the step of primary pinch seal (provisional pinch seal), FIG. 7(*b*) being a view for explaining the step of primary pinch seal (final pinch seal), FIG. 7(*c*) being a view for explaining the step of inputting a light emitting substance or the like, FIG. 7(*d*) being a view for explaining the step of performing chip off, and FIG. 7(*e*) being a view for explaining the step of performing chip off.

As shown in FIG. 7(*a*), while an insert gas is supplied from the nozzle 40 into the glass tube W and an inert gas is supplied from the pipe 50 into the lower end portion of the glass tube W, a position (a position inclusive of the sheet of molybdenum foil 7) of the linear stretched portion w1 near to the spherical swollen portion w2 is heated to 2100° C. by burners 24*a* and the lead wire 8 connection side of the sheet of molybdenum foil 7 is provisionally pinch-sealed by pinchers 26*a*.

After the provisional pinch seal is finished, as shown in FIG. 7(*b*), the inside of the glass tube W is kept in a vacuum (a pressure of 400 Torr or less) by a vacuum pump (not shown) and a non-pinch-seal portion inclusive of the sheet of molybdenum foil 7 is heated to 2100° C. by burners 24*b* so as to be finally pinch-sealed by pinchers 26*b*. Incidentally, the degree of vacuum made to act on the inside of the glass tube W is preferably in a range of 400 Torr to $4\times10^{-3}$ Torr.

In such a manner, the primary pinch seal portion 13A gets into a state in which a glass layer 15 adheres to the electrode rod 6, the sheet of molybdenum foil 7 and the lead wire 8 constituting the electrode assembly A. In particular, the portion finally pinch-sealed has a state that the glass layer and the sheet of molybdenum foil 7 (electrode rod 6) are firmly bonded to each other because the glass layer closely adheres to and is sufficiently familiar with the electrode rod 6 and the sheet of molybdenum foil 7. Accordingly, the sheet of molybdenum foil 7 and the silica glass in the primary pinch seal portion 13A are integrally bonded to each other with a high mechanical bonding strength in which glass is closely packed in the micro-asperity of the roughened surface 7*c* of the sheet of molybdenum foil 7.

Also in the final pinch seal step, when the lower opening portion of the glass tube W is kept in an atmosphere of an insert gas (argon gas or nitrogen gas), the lead wire 8 can be prevented from being oxidized.

Subsequently, as shown in FIG. 7(*c*), a light emitting substance P or the like is put into the spherical swollen portion w2 through the upper opening end side of the glass tube W. The other electrode assembly A' having an electrode rod 6 and a lead wire 8 integrally welded to the sheet of molybdenum foil (the sheet of molybdenum foil having a roughened surface 7*c* of a micro-asperity shape) 7 subjected to a surface roughing etching treatment (oxidation and reduction treatments) is further inserted and kept in a predetermined position.

The lead wire 8 has a W-shaped bent portion 8*b* provided on the way in the longitudinal direction thereof. The bent portion 8*b* is formed to come into pressure contact with the inner circumferential surface of the glass tube W, so that the electrode assembly A' can be positioned and retained in a predetermined position in the longitudinal direction of the linear stretched portion w1.

After the glass tube W is evacuated, as shown in FIG. 7(*d*), a predetermined upper portion of the glass tube W is chipped off while a xenon gas is supplied into the glass tube W, so that the electrode assembly A' is provisionally sealed and a light emitting substance or the like is enclosed in the glass tube W. The reference symbol W3 designates a chip-off portion.

Thereafter, as shown in FIG. 7(*e*), while the spherical swollen portion w2 is cooled with liquid nitrogen ($LN_2$) so that the light emitting substance P or the like is not gasified, a position (a position inclusive of the sheet of molybdenum foil) of the linear stretched portion w1 near to the spherical swollen portion w2 is heated to 2100° C. by burners 24 so as to be secondarily pinch-sealed by pinchers 26*c*. In this manner, the spherical swollen portion w2 is sealed, so that the arc tube 10 having the chipless closed glass bulb 12 provided with the pair of opposite electrodes 6 and 6 and filled with the light emitting substance P or the like can be completed.

Unlike the final pinch seal in the primary pinch seal step, in the secondary pinch seal step, the pressure of the inside of the glass tube W need not be made negative by a vacuum pump but can be kept negative (about 400 Torr) when the xenon gas enclosed in the glass tube W is liquefied. Hence, the degree of adhesion of the glass layer to the electrode assembly A' (having the electrode rod 6, the sheet of molybdenum foil 7 and the lead wire 8) in the secondary pinch seal portion 13B is excellent.

That is, similar to the case of the final pinch seal in the primary pinch seal step, a negative pressure also acts on the glass layer heated and softened, in addition to the pressing force of the pinchers 26*c*. Hence, the glass layer closely adheres to and becomes familiar with the electrode rod 6, the sheet of molybdenum foil 7 and the lead wire 8, so that the glass layer is formed to be firmly bonded to the electrode 6, the sheet of molybdenum foil 7 and the lead wire 8. In particular, also in this secondary pinch seal portion 13B, the molybdenum foil 7 and the silica glass are integrally joined to each other with a high mechanical bonding strength in which glass is closely packed in the micro-asperity of the surface 7*c* of the sheet of molybdenum foil 7 in the same manner as in the lower, primary pinch seal portion 13A. Finally, the glass tube is cut into a predetermined length at end portions thereof to obtain the arc tube 10 shown in FIG. 1.

Incidentally, there is practically provided a step of welding the shroud glass G to the arc tube 10 and enclosing an inert gas between the shroud glass G and the arc tube 10. The shroud glass welding/inert gas enclosing step is substantially the same as the shroud glass welding/inert gas enclosing step employed in the process for producing the arc tube shown in FIG. 8 and does not directly relate to the process for producing the arc tube 10. Hence, the description of the step will be omitted.

Although the embodiment has shown the case where the glass tube is chipped off so that a light emitting substance or the like is enclosed in the glass tube after the primary pinch seal and before the secondary pinch seal, the glass tube may be directly pinch-sealed without chipping-off so that a light emitting substance or the like is enclosed after the primary pinch seal.

Although the embodiment has shown the case where the surface roughening etching treatment of the sheet of molybdenum foil is formed so that the sheet of molybdenum foil is subjected to the oxidation treatment in the oxidation treatment furnace and then subjected to the reduction treatment in the reduction treatment furnace, the sheet of molybdenum foil may be directly heated by oxygen/hydrogen burners so that oxidation and reduction are performed simultaneously. In this manner, the surface roughening etching treatment step for the sheet of molybdenum foil is shortened.

As is obvious from the above description, in the discharge lamp arc tube according to a first aspect of the invention, the adhesion, that is, mechanical bonding strength in the interface between silica glass and molybdenum foil in the pinch seal portion is improved so that foil rising in the pinch seal portion is steadily prevented and, accordingly, the long lifetime of the arc tube can be achieved.

In the method for producing the discharge lamp arc tube according to a second aspect of the invention, the adhesion, that is, mechanical bonding strength in the interface between silica glass and molybdenum foil in the pinch seal portion is improved so that a long-lifetime arc tube free from foil rising in the pinch seal portion can be provided.

According to third and fourth aspects of the invention, the mechanical strength of the sheet of molybdenum foil is ensured and the yield of arc tubes produced is improved.

According to a fifth aspect of the invention, the silica glass in the pinch seal portion is formed to be surely and closely packed in the micro-asperity of the surface of the sheet of molybdenum foil. Accordingly, the adhesion, that is, mechanical bonding strength in the interface between silica glass and molybdenum foil is improved so that foil rising in the pinch seal portion is steadily prevented and, therefore, the long lifetime of the arc tube can be achieved.

What is claimed is:

1. A method for producing a discharge lamp arc tube having molybdenum foil with a rough surface at pinch seal portions of the arc tube comprising:

etching the molybdenum foil to provide the molybdenum foil with the rough surface;

preparing a pair of electrode assemblies, each including an electrode, the molybdenum foil, and a lead wire integrally series-connected to one another; and pinch sealing molybdenum foil-containing portions of the electrode assemblies with glass portions of the arc tube to form the pinch seal portions of the arc tube.

2. The method for producing a discharge lamp arc tube having molybdenum foil with a rough surface at pinch seal portions of the arc tube according to claim 1, wherein the etching comprises an oxidation treatment and a reduction treatment of the molybdenum foil.

3. The method for producing a discharge lamp arc tube having molybdenum foil with a rough surface at pinch seal portions of the arc tube according to claim 2, wherein a temperature used for the oxidation treatment of the molybdenum foil is set to be in a range of 300° C. to 500° C.

4. The method for producing a discharge lamp arc tube having molybdenum foil with a rough surface at pinch seal portions of the arc tube according to claim 2, wherein during the oxidation treatment, an atomic percentage of oxygen in the molybdenum foil is set to be in a range of 50% to 80%.

5. The method for producing a discharge lamp arc tube having molybdenum foil with a rough surface at pinch seal portions of the arc tube according to claim 4, wherein the atomic percentage of oxygen is set to be in a range of 60% to 70%.

6. The method for producing a discharge lamp arc tube having molybdenum foil with a rough surface at pinch seal portions of the arc tube according to claim 1, wherein a temperature used for the pinch sealing process is set to be in a range of 2000° C. to 2300° C.

7. The method for producing a discharge lamp arc tube having molybdenum foil with a rough surface at pinch seal portions of the arc tube according to claim 1, wherein the rough surface comprises a micro-asperity shape.

8. The method for producing a discharge lamp arc tube having a molybdenum foil with a rough surface at pinch seal portions of the arc tube according to claim 1, wherein the etching comprises:

an oxidation treatment to form an oxide film on the molybdenum foil; and a reduction treatment removing oxygen atoms in the oxide film to form a roughened surface.

9. The method for producing a discharge lamp arc tube having molybdenum foil with a rough surface at pinch seal portions of the arc tube according to claim 8, wherein a temperature used for the oxidation treatment of the molybdenum foil is set to be in a range of 300° C. to 500° C.

10. The method for producing a discharge lamp arc tube having molybdenum foil with a rough surface at pinch seal portions of the arc tube according to claim 8, wherein during the oxidation treatment, an atomic percentage of oxygen in the molybdenum foil is set to be in a range of 50% to 80%.

11. The method for producing a discharge lamp arc tube having molybdenum foil with a rough surface at pinch seal portions of the arc tube according to claim 10, wherein the atomic percentage of oxygen is set to be in a range of 60% to 70%.

* * * * *